US006681975B2

(12) United States Patent
Yamaguchi

(10) Patent No.: US 6,681,975 B2
(45) Date of Patent: Jan. 27, 2004

(54) ELECTRIC STAPLER

(75) Inventor: Morio Yamaguchi, Tokyo (JP)

(73) Assignee: Max Co., Ltd., Tokyo (JP)

( * ) Notice: Subject to any disclaimer, the term of this patent is extended or adjusted under 35 U.S.C. 154(b) by 123 days.

(21) Appl. No.: 09/919,799

(22) Filed: Aug. 2, 2001

(65) Prior Publication Data

US 2002/0017549 A1 Feb. 14, 2002

(30) Foreign Application Priority Data

Aug. 2, 2000 (JP) ..... 2000-234936

(51) Int. Cl.[7] ..... B27F 7/21; B27F 7/36; B27F 7/17

(52) U.S. Cl. ..... 227/82; 227/120; 227/155

(58) Field of Search ..... 227/146, 131, 227/132, 124, 120, 155, 82

(56) References Cited

U.S. PATENT DOCUMENTS 5,009,355 A * 4/1991 Akizawa et al. ..... 227/131
5,141,143 A 8/1992 Ebner et al. ..... 227/129
5,269,451 A * 12/1993 Udagawa et al. ..... 227/120
5,454,503 A * 10/1995 Udagawa et al. ..... 227/120
5,460,314 A * 10/1995 Udagawa ..... 227/131
5,806,750 A 9/1998 Yamanushi et al. ..... 227/155
5,975,396 A * 11/1999 Manabe ..... 227/131

FOREIGN PATENT DOCUMENTS

EP 0 612 594 A1 8/1994

* cited by examiner

*Primary Examiner*—Rinaldi I. Rada
*Assistant Examiner*—Michelle Lopez
(74) *Attorney, Agent, or Firm*—Morgan, Lewis & Bockius LLP

(57) ABSTRACT

A driver unit of a vertically slidable type is constructed by mounting a staple cartridge to a cartridge holder so as to freely slide in a vertical direction, and by urging the staple cartridge toward a clincher unit opposed thereto by a spring. When a clincher sleeve has descended to push the staple cartridge, the staple cartridge will move up and down in parallel, and accordingly, a relative angle of a clincher to a driver plate will not change.

2 Claims, 4 Drawing Sheets

ELECTRIC STAPLER

BACKGROUND OF THE INVENTION

1. Field of the Invention

The present invention relates to an electric stapler, and more particularly, to an electric stapler in which a clincher and a driver are separated from each other and arranged in a vertical direction.

2. Description of the Related Art

FIG. 4 shows an electric stapler adapted to be incorporated mainly in a copying machine. A clincher unit 1 and a driver unit 2 are vertically separated from each other in order to bind a document at its center portion. The clincher unit 1 is fixed to an upper base plate 3, and the driver unit 2 is fixed to a lower base plate 4 which is arranged in parallel to the upper base plate 3 spaced therefrom.

Into a clincher guide 5 formed in a vertical direction in a front part (a left side in the drawing) of the clincher unit 1, a clincher sleeve 6 and a clincher 7 are inserted. The clincher sleeve 6 and the clincher 7 are driven to move up and down by means of a motor 8, a reduction gear train 9, cam levers 10 at left and right sides (in a direction of Z axis in the drawing), and a central cam lever 11.

When the motor 8 is energized, the cam levers 10 at the left and right sides, which are engaged with an eccentric roller 12 attached to a final reduction gear 9*a*, move upward and downward about a shaft 13 as a pivotal axis. The clincher sleeve 6 and the clincher 7, which are engaged in elongated holes in front parts of the cam levers 10, perform one cycle of a reciprocating motion in which they move upward to return to the standby position after they have moved downward from a standby position. On this occasion, after the clincher sleeve 6 has come into contact with sheets of paper to discontinue the downward movement, the central cam lever 11 further pushes down the clincher 7, and the clincher 7 bends legs of the staple which has entered in the clincher sleeve 6, into a flat shape.

The driver unit 2 is so designed that its front part freely moves up and down within a determined range about a shaft 14 in its rear part as a pivotal axis, and is urged to an elevated position by means of a compression spring 15. Into a driver guide 16 in the front part of the driver unit 2, a driver plate 17 and a forming plate 18 are inserted in an overlapped manner. A lower end of the driver plate 17 is in contact with a stopper 19 provided on a frame of the stapler. Numeral 20 designates a staple cartridge. A staple sheet S to which a number of straight staples are bonded in parallel is loaded in the staple cartridge 20.

FIG. 5 shows the electric stapler in operation. When the clincher sleeve 6 and the clincher 7 move downward to push down the front part of the driver unit 2, other parts than the driver plate 17 and the forming plate 18 which are in contact with the stopper 19 rotate downward. With this rotation, the driver plate 17 is projected upward from the driver unit 2. A staple in a foremost row inside the driver guide 16 is pushed upward and clamped by means of the clincher sleeve 6 and the clincher 7 to pass through the document (not shown), and both left and right legs of the staple are bent inwardly by means of the clincher 7. At the same time, a staple in the next row of the ejected staple is formed by the forming plate 18 into a bent shape like a gate.

As described above, the conventional electric stapler has such a structure that the clincher sleeve 6 slides downward rectilinearly to push the driver unit 2, and the driver unit 2 rotates downwardly about the shaft 14 as the pivotal axis. Accordingly, when the document has been clamped between the clincher sleeve 6 and the driver unit 2, an angle of the driver plate 17 and an ejection angle of the staple may change according to thickness of the document. For this reason, the clincher sleeve 6 must be accurately aligned with the driver plate 17 so as to follow a change of the angle of the driver plate 17. Even a minor error in the alignment may result in distortion or clogging of the staples, and there has been a problem that high accuracy is required with respect to precision of the components and assembling work, and assembling adjustment is also difficult.

Therefore, there has arisen a technical problem to be solved for stabilizing the stapling that the clincher and the driver plate must be arranged so as to face with each other at a constant angle regardless of thickness of the document to be bound. An object of the present invention is to solve the above described problem.

SUMMARY OF THE INVENTION

This invention has been made in order to attain the above described object and to provide a electric stapler for binding a document inserted between a driver unit and a clincher unit, the electric stapler comprising the driver unit including a driver plate adapted to eject staples and a staple cartridge, and the clincher unit including a clincher adapted to bend legs of each of the staples which have been ejected and a clincher driving mechanism, wherein the driver unit and the clincher unit are separated from each other and arranged in a vertical direction. The electric stapler is characterized in that the driver unit is composed of a cartridge holder fixed to a frame of the electric stapler, said staple cartridge mounted to the cartridge holder so as to freely slide up and down, a spring for urging the staple cartridge toward the clincher unit opposed thereto, and the driver plate incorporated in the cartridge holder, the clincher of the clincher unit being so constructed as to push the staple cartridge to slide, whereby the staples in the staple cartridge are ejected by means of a driver in the cartridge holder.

DETAILED DESCRIPTION OF THE PREFERRED EMBODIMENT

Figure 1:
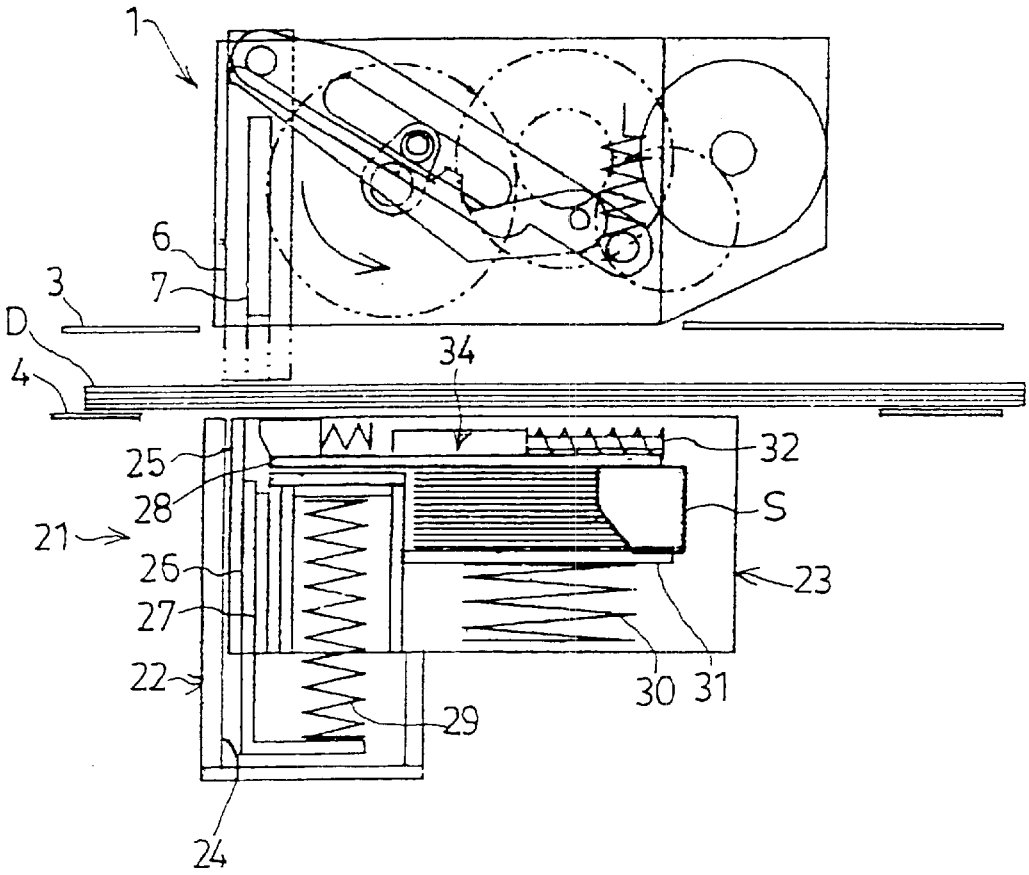
FIG. 1 is an explanatory view in a longitudinal section of a electric stapler in one embodiment according to the invention.
Figure 4:
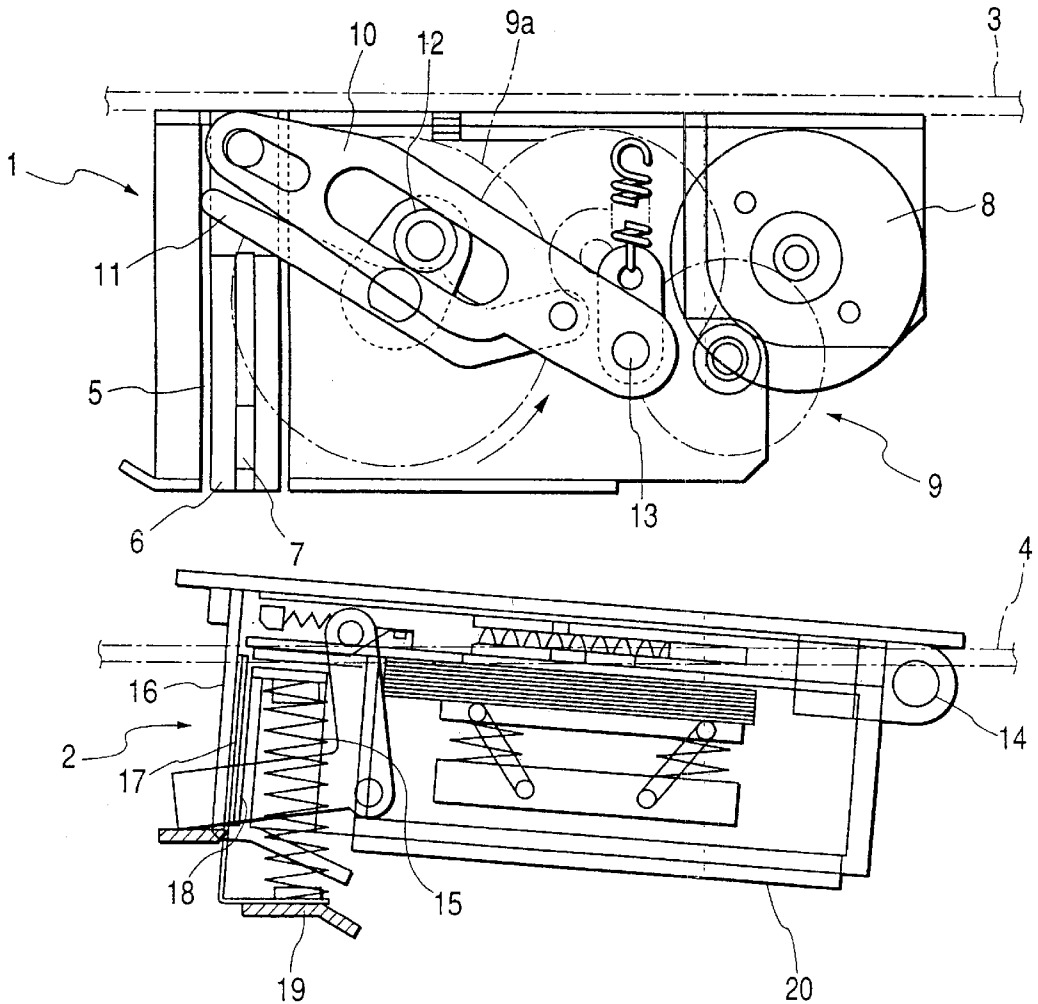
FIG. 4 RELATED ART
FIG. 4 is an explanatory view in a longitudinal section of a electric stapler in a conventional example.
Figure 5:
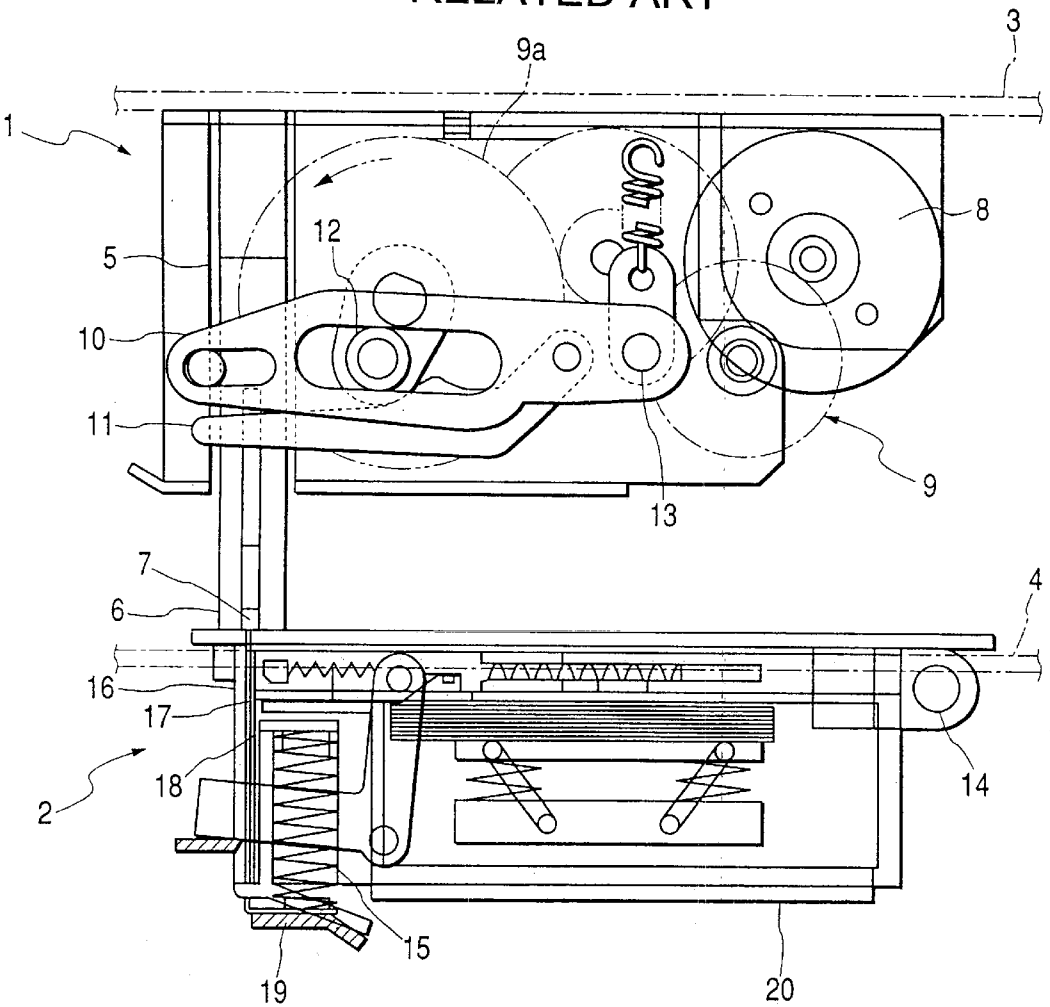
FIG. 5 RELATED ART
FIG. 5 is an explanatory view in a longitudinal section of the electric stapler in operation in the conventional example.

An embodiment according to the invention will be described in detail referring to the drawings. FIG. 1 shows an electric stapler, in which a clincher unit 1 and a driver unit 21 are separated vertically. The clincher unit 1 is fixed to an upper base plate 3, and the driver unit 2 is fixed to a lower base plate 4. Because the clincher unit 1 has the same structure as in the conventional electric stapler as shown in FIG. 4, the clincher unit 1 will not be further described, but the driver unit 21 only will be described here.

The driver unit 21 comprises a cartridge holder 22 fixed to a frame (not shown) of the electric stapler and a staple cartridge 23 mounted to the cartridge holder 22. The staple cartridge 23 is engaged with guide grooves 24 formed in a vertical direction on an inner wall face of the cartridge holder 22 at left and right sides thereof (in a direction of Z axis in the drawing). The staple cartridge 23 is held by the cartridge holder 22 in such a manner that it can slide up and down.

The staple cartridge 23 is provided with a driver guide 25 in a vertical direction in a front part thereof (a left side in the drawing). Into the driver guide 25, there are inserted a driver plate 26 and a forming plate 27.

A lower end of the driver plate 26 is bent in an L-shape. A compression spring 29 inserted between the L-shaped bent portion and a staple guide 28 in an upper part urges the staple cartridge 23 upward. A pressure plate 31 is provided on a bottom inside the staple cartridge 23 interposing a compression spring 30, and a staple sheet S piled on the pressure plate 31 is pressed to a ceiling face of the staple guide 28.

Figure 2:
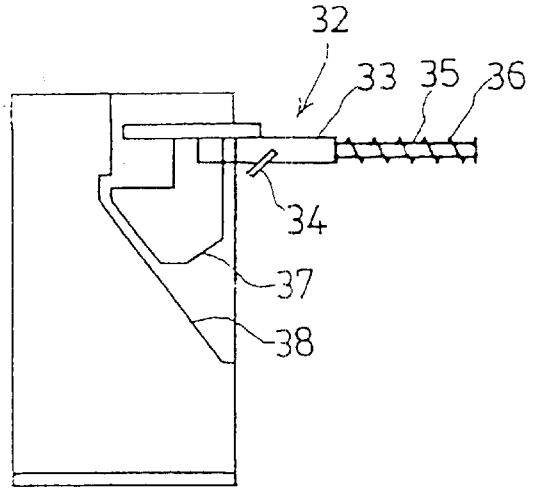
FIG. 2 is an explanatory view in a longitudinal section of a feeding claw mechanism in a driver unit as shown in FIG. 1.

There is provided a feeding claw unit 32 on the staple guide 28 so as to freely slide back and forth. FIG. 2 shows the feeding claw unit 32 which includes a slide plate 33, a feeding claw 34 provided on a lower face of the slide plate 33 and directed diagonally downward in a forward direction, and a shaft 35 provided in a rear part of the slide plate 33 and loaded with a compression spring, so that the feeding claw unit 32 is urged forward in the staple cartridge 23.

At both left and right sides of a front part of the slide plate 33, there are formed cams 37 which are oriented downward. The cams 37 are respectively engaged with backwardly slanted cam grooves 38 which are formed on left and right inner wall faces of the cartridge holder 22. Accordingly, when the staple cartridge 23 has moved downward with respect to the fixed cartridge holder 22, the feeding claw unit 32 retreats along slanted faces of the cam grooves 38, and the feeding claw 34 slides along a surface of the staple sheet S. On the contrary, when the staple cartridge 23 has moved upward, the feeding claw unit 32 is pressed by means of the compression spring 36 and moves forward. On this occasion, the feeding claw 34 is brought into engagement with a groove between the staples of the staple sheet S to feed the staple sheet S in a forward direction.

It is also advantageous that because there is no shaft for supporting the driver unit in the rear part of the staple cartridge (a right side in the drawing), different from the conventional driver unit, the staple sheet S can be loaded into the staple cartridge from the back, and operability will be enhanced.

Then, operation of the electric stapler will be described. When a document D has been fed between the clincher unit 1 and the driver unit 21 in a standby state as shown in FIG. 1, the motor 8 of the clincher unit 1 is energized by a document detecting signal from a sensor which is not shown. Then, the clincher sleeve 6 and the clincher 7 integrally descend as described in the conventional example, and press the document D onto an upper face of the staple cartridge 23 to push the document D and the staple cartridge 23 downward.

Figure 3:
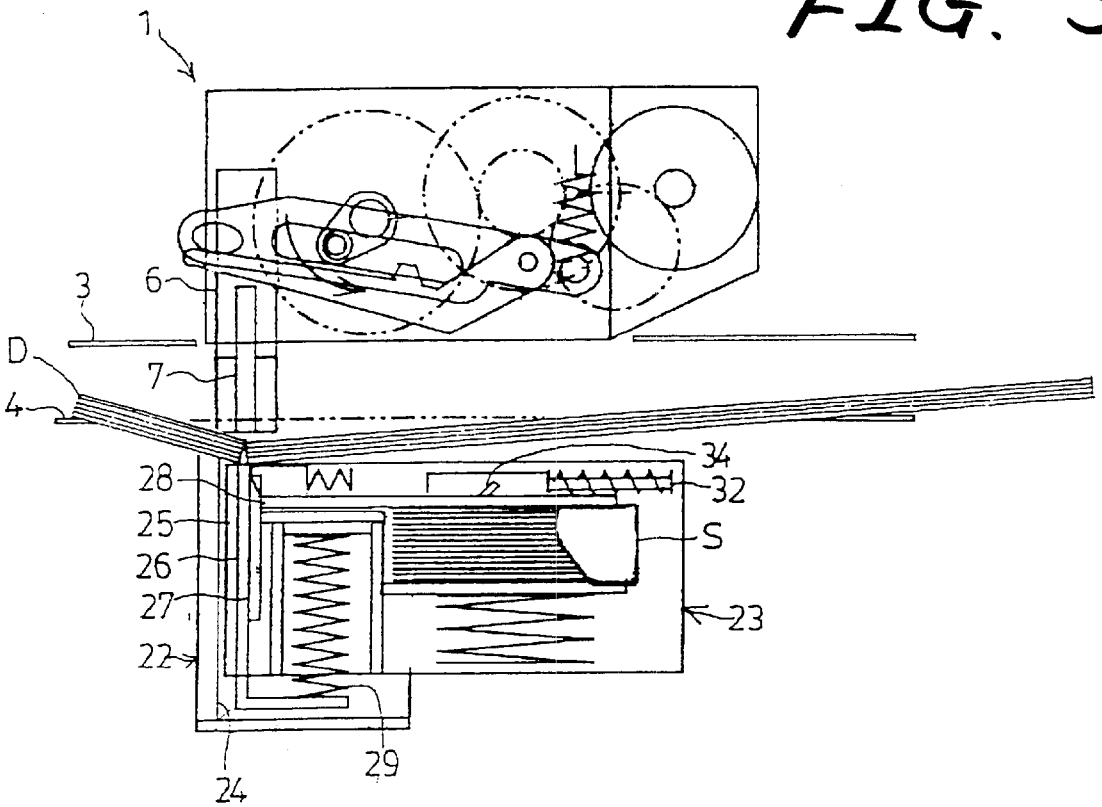
FIG. 3 is an explanatory view in a longitudinal section of the electric stapler in operation.

At this moment, the driver plate 26 and the forming plate 27 will not descend because they are in contact with the bottom face of the cartridge holder 22 at their lower ends, but the staple cartridge 23 will descend as shown in FIG. 3. Accordingly, the driver plate 26 is projected upward from the driver guide 25. With this motion, the staple in the staple guide 28 will be ejected by the driver plate 26 and the legs of the staple which have passed through the document D will be pressed into the clincher sleeve 6.

Although not shown in the drawings, an opening of the clincher sleeve 6 at its lower end is in a diverged trapezoidal shape in a sectional view as seen from a front face, by which the legs of the staple which have been pressed in the opening of the clincher sleeve 6 can be bent inwardly. Then, the central cam lever 11 of the clincher unit 1 further pushes down the clincher 7 thereby to bend the legs of the staple, which have been pushed into the clincher sleeve 6, into a flat shape.

Simultaneously with the above described stapling motion, the leading staple in the driver guide of the driver unit 21 will be bent at both left and right sides thereof at the right angle by means of the forming plate 27 to be formed into a shape like a gate.

Thereafter, the clincher sleeve 6 and the clincher 7 proceed into an ascending stroke and are returned to the standby position as shown in FIG. 1. The driver unit 21 released from the pressure will also ascend to the standby position, while the driver plate 26 and the forming plate 27 will descend relatively, and the leading staple will be supplied into the driver guide 25 by means of the feeding claw 34.

It is apparent that the invention is not limited to the above described embodiment, but various modifications can be made in a technical scope of this invention, and that the invention also covers those which have been modified.

As described herein above, the electric stapler according to the invention has such a structure that the staple cartridge of the driver unit moves up and down in parallel with respect to the standby position to eject the staple by means of the driver plate in the cartridge holder. Therefore, different from the conventional driver unit which is adapted to rotate up and down about the shaft as the pivotal axis, the relative angle of the clincher to the driver plate will not change. Thus, the stapling will be stabilized and a fear of an accident such as distortion or clogging of the staples can be avoided.

What is claimed is:

1. An electric stapler for binding a document, comprising:

a clincher unit including a clincher driving mechanism and a clincher for bending legs of a staple; and a driver unit including a cartridge holder fixed to a frame of said electric stapler, a staple cartridge loading staples and mounted to said cartridge holder so as to freely slide up and down, a driver plate incorporated in said cartridge holder for ejecting the staple, a spring for urging said staple cartridge toward said clincher unit opposed thereto, wherein said clincher unit and said driver unit are separated from each other and arranged in a vertical direction, and a document is inserted and bound between said clincher unit and said driver unit, and a wherein said clincher driving mechanism and said clincher are arranged such that said clincher of said clincher unit slides said staple cartridge so that the staple in said staple cartridge are ejected by said driver plate in said cartridge holder.

2. The electric stapler according to claim 1, wherein a relative angle of said clincher to said driver plate keeps constant during operation.

* * * * *